United States Patent [19]

Montali et al.

[11] Patent Number: 4,858,837

[45] Date of Patent: Aug. 22, 1989

[54] DEVICE AND METHOD FOR INTERMITTENTLY STORING AND RETURNING YARN DURING THE WINDING OF CONICAL BOBBINS FED WITH YARN AT CONSTANT SPEED

[75] Inventors: Sergio Montali; Francesco Ferro; Luigi Colli, all of Pordenone, Italy

[73] Assignee: Savio, S.p.A., Pordenone, Italy

[21] Appl. No.: 169,495

[22] Filed: Mar. 17, 1988

[30] Foreign Application Priority Data

Mar. 19, 1987 [IT] Italy ..... 19756 A/87

[51] Int. Cl.[4] ..... B65H 54/06; B65H 54/10

[52] U.S. Cl. ..... 242/18 R; 242/18 DD; 242/154

[58] Field of Search ..... 242/18 R, 18 DD, 45, 242/25 R, 147 R, 153, 154

[56] References Cited

U.S. PATENT DOCUMENTS

| | | | |
|---|---|---|---|
| 3,231,216 | 6/1966 | Lemarchand | 242/150 R |
| 3,640,477 | 2/1972 | Furst | 242/18 DD |
| 4,002,306 | 1/1977 | Raasch | 242/18 DD |
| 4,083,506 | 4/1978 | Mander et al. | 242/25 R |
| 4,113,193 | 9/1978 | Raasch et al. | 242/18 DD |

FOREIGN PATENT DOCUMENTS

| | | |
|---|---|---|
| 2271162 | 12/1975 | France . |
| 2125072 | 2/1984 | United Kingdom . |

OTHER PUBLICATIONS

Wire and Wire Products, vol. 27, Apr. 1962, pp. 496–503, 538, 539 Patent Abstracts of Japan, vol. 10, No. 134 (M–479)[2191], 5/17/86.

*Primary Examiner*—Stanley N. Gilreath

*Attorney, Agent, or Firm*—Hedman, Gibson, Costigan & Hoare

[57] ABSTRACT

A yarn storage and return device for yarn being wound on a conical bobbin driven at a constant speed. The device comprises a lever system for storing and returning the yarn and for regulating and monitoring the amount of stored yarn. The yarn is drawn into the storage position by an arm of the lever system and is then released (i.e. returned) from this storage position. This returning operation releases the yarn from its storage position and replaces it (returns it), to its normal feed path. The device also comprises a yarn tension measurer, an electric comparator, and an electric control unit to measure and compare the yarn tension, and to process an electric controlling signal to activate a drive motor. The drive motor actuates a tensioning element which affects the storage operation of the device.

4 Claims, 1 Drawing Sheet

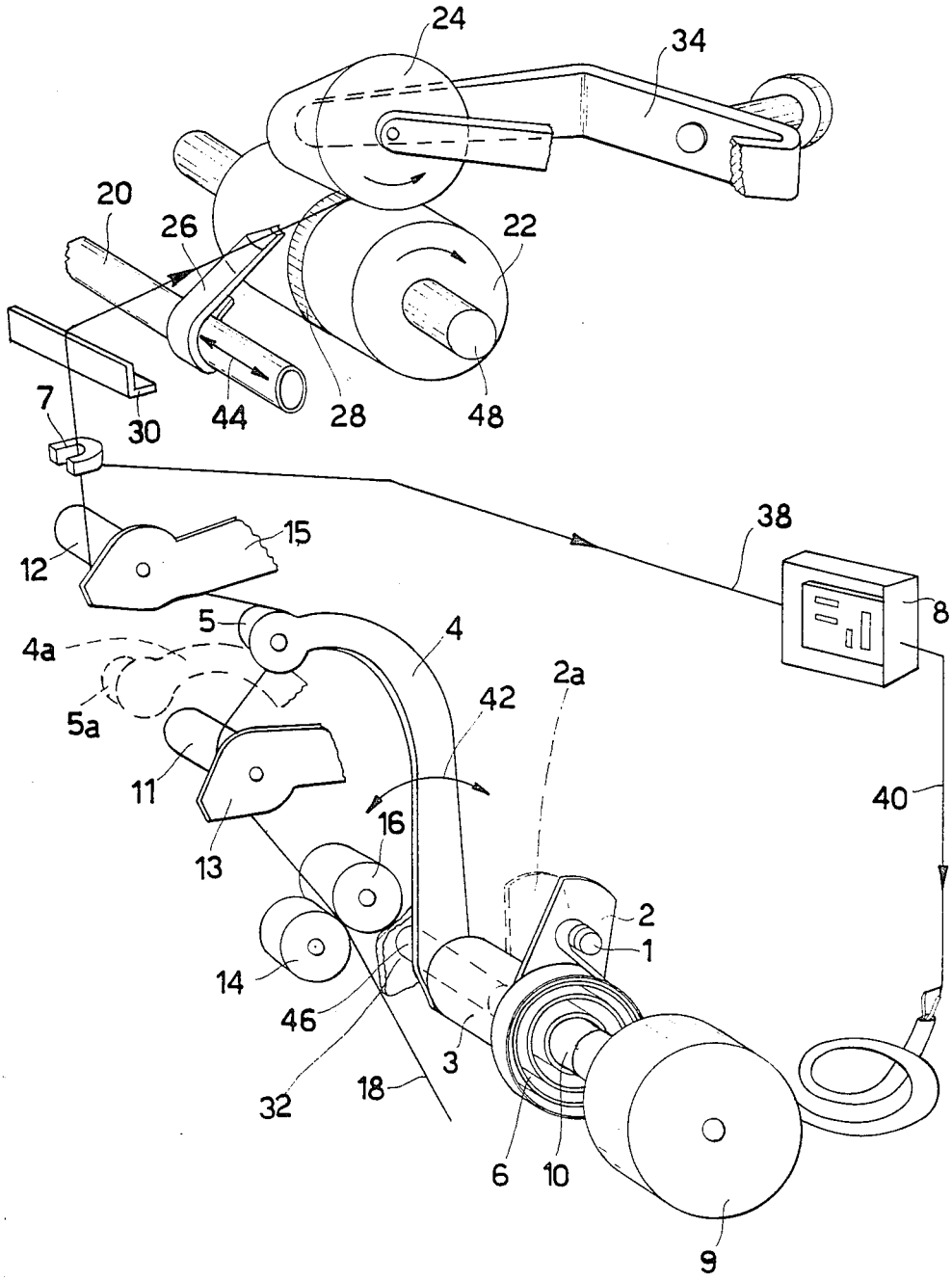
24
34
20
26
22
7
30
44
28
48
38
12
15
8
5
4
4a
2a
42
5a
11
40
16
13
2
1
14
46
3
32
18
6
10
9

DEVICE AND METHOD FOR INTERMITTENTLY STORING AND RETURNING YARN DURING THE WINDING OF CONICAL BOBBINS FED WITH YARN AT CONSTANT SPEED

The invention relates to a device and method for intermittently storing and returning yarn during the winding of conical bobbins with yarn withdrawn at constant speed from individual spinning units.

More particularly, the invention relates to a yarn storage and return device in which storage capability for the intermittent supply of yarn and a tension compensator and regulator for the yarn being wound are combined.

In spinning units, the yarn emerges at their outlet at constant speed from the feed rollers and must be deposited at a speed which varies between the major diameter and minor diameter of the conical bobbin being formed.

In such an operational process it is therefore necessary to periodically vary the yarn length in the section between the feed rollers and its point of deposition on the circumference of the conical bobbin. This length variation and the consequent variation in yarn tension are compensated by adjusting the yarn path by means of a winding tension regulator and compensator device.

Tension compensators are known in the art. They comprise a deflecting roller connected to a rocker arm. Depending on the instantaneous yarn tension, or rather according to the instantaneous position of the rocker arm, the mobile deflecting roller is deviated to a varying extent from its contact or bearing position, this position being assumed by the action of a force exerted by a counterweight, a spring or a similar elastic element. These yarn tension compensators have the drawback of exerting an elastic opposing force which cannot be controlled in respect of the tension variations which can occur in the yarn in the case of non-regular storage.

In an individual winding position a constantly rotating substantially cylindrical drive roller rotates the conical bobbin under formation, the dimensions of which, together with the taper and angle of the winding helix determine the angular swing amplitude of the mobile arm.

The swing position of this latter, which keeps a roller connected to it constantly adhering to the yarn, represents the yarn storage value, which constantly increases and decreases according to the stage in the progress of the entire yarn storage and return cycle. Any slippage between the drive roller and bobbin under formation, which frequently occurs due to the friction drive used, increases the length of yarn stored and changes the swing position of the mobile arm which, under the action of the elastic element acting in a pulling capacity, is moved in the limit into an abutting position, consequently nullifying the tension of the yarn being collected. Without tension, this latter winds with irregular turns, so prejudicing the bobbin formation and in the limit the yarn twists about itself to create knots and tangles such as to compromise the yarn consistency.

The tangled yarn also frequently creates obstacles such as to interrupt yarn continuity, so blocking the spinning process. The high yarn formation rate of spinning units means that any production hold-up in such spinning units assumes considerable importance because of the reduced rate of yarn collection in the form of bobbins.

Yarn tension compensators of this type also have the drawback that if the yarn count or thickness, the type of bobbin under formation or the winding helix angles varies, they have to be adapted to this by onerous manual adjustments to the individual spinning stations, or by replacing the elastic element with another elastic element which conforms to the different operating characteristics. These devices are therefore inflexible in use.

Devices for intermittently storing and returning yarn, preferably for textile machines, are also known. These include by way of example the devices described and claimed in the German Pat. Nos. DE 1785153 and DE 1454917.

Such devices have numerous drawbacks: they are insensitive to tension and even less to tension variations in the winding yarn because the storage and return element is of a type which, by means of a lever system, is completely controlled by a to-and-fro drive rod which passes along the entire machine face to operate the yarn stores of all the spinning units. They are unable to adjust the yarn tension to one or more predetermined values preset according to the type of yarn being collected or of the bobbin under formation. They present considerable difficulty in adjusting the value preset for the storage of the yarn being wound, as this adjustment must be made manually by an operator by adjusting the length of the connecting rods or the positions of the lever rotation pivots in order to vary the lever arms. Said adjustment is therefore lengthy, laborious and variable according to the geometrical characteristics of the bobbin under formation and the winding helix angle. They also have a rather high inertia force due to the presence of several lever systems which are mobile simultaneously but intermittently, and tend to trigger uncontrollable vibratory oscillation and at the same time limit the collection rate. They also set limits on the machine length and therefore on the number of spinning units as their operation relies on drive rods which have to extend along the face of the collection units and are subjected to large numbers of to-and-fro movement strokes. These devices are also rather bulky and inefficient when slippage is present between the conical bobbin under formation and the drive roller. This slippage, which is more or less accentuated, is often present because the conical bobbin being cross-wound continuously rests against a drive roller which on a determined but narrow part of its surface possesses a friction band for friction drive purposes.

A further drawback of such devices is the presence of mobile members, such as rods or shafts, which have to be provided and mounted at the commencement of machine construction, and cannot be fitted later.

Said mobile members control the operation of several storage devices and extend along the entire winding face from a position at the head of the machine. Because of the principle on which they are constructed, these devices are therefore inflexible and unadaptable to pre-existing spinning stations or stations not provided with the aforesaid mobile members which pass along the front structure of the entire collection face.

An object of the present invention is to obviate the aforesaid drawbacks by providing a storage and intermittent return device wherein yarn is drawn into the storage position and is then released from this storage position (i.e. returned). This returning operation releases the yarn from its storage position and replaces it (returns it), to a normal feed path. This device, winding conical bobbins fed with yarn at constant speed has the following advantages:

enables the stored length to be always maintained within a preset range of values with only limited variations in yarn tension allows the immediate takeup of any additional yarn lengths accidentally present due to slippage between the drive roller and conical bobbin under formation does not limit the yarn collection speed in the formation of conical bobbins does not set limits on the machine length and thus does not limit the number of winding units to be positioned side by side, as these do not require for their operation any drive member extending along the entire winding face, and therefore do not possess further masses moving longitudinally to the machine and connected to drive rods subjected to reciprocating to-and-fro movement does not limit the diameter of the bobbins obtainable and does not require laborious adjustment to be made when changing the taper of the bobbin under formation has extreme operational flexibility such as to allow a range of application which enables soft or compact bobbins to be made up within a vast range of yarn counts without the need for laborious mechanical adjustments can be applied without the need for extensive demounting and remounting of the component parts of the winding machine if this, being already set for forming cylindrical bobbins, is to be converted for forming conical bobbins can be easily disengaged so as to make it possible to form both conical and cylindrical bobbins on the same machine.

A further object of the present invention is to provide a yarn storage and return device requiring very little maintenance. These and further objects are all attained by the yarn storage and return device of the present invention, in particular for textile machines operating to form conical bobbins, characterised by comprising:

a lever system having two flat elements, and being able to move with swing motion about an axis by means of a bush positioned as a rigid element joining together said flat elements, of which one acts, in union with a deflecting roller, as a yarn storage and return arm and, at the same time, as a tension compensator and regulator element for the yarn being wound, and the other flat element acts as an attachment and connection element for the mobile end eyelet of a spiral elastic element subjected to pretension in order to generate an opposing force which balances the force produced by the tension of the yarn being wound an electronic or like tension sensor of known type, which measures the tension of the yarn being wound in order to generate a corresponding series of electrical signals the values of which are such as to provide at every moment an unambiguous indication of the tension of the yarn being wound onto the conical surface of the bobbin an electronic comparator which compares said electrical signals with one or more reference signals which define the ends of the regular yarn tension range, in order to generate a control signal when a signal arises having a value which is outside the range of values corresponding to said regular range an electronic control unit, in the form of a processor means of know type, which converts said control signal into a signal which activates the operation of a drive source a drive source which, under the influence of said control signal, increases or decreases the preloading of the spiral elastic element in order to adjust the storage arm to a yarn tension value which is slightly higher or slightly lower than its previous value, so as to rapidly restore the winding tension to within the range of values corresponding to regular tension. According to one embodiment, the device is present in each yarn winding position.

According to a further embodiment, the device is autonomous and independent of any mechanical link with the yarn guide element or with the bobbin carrier arm.

The device according to the invention has the advantage, for any variation in the type of yarn and type of bobbin under formation, of automatically adjusting and setting the tension of the yarn being collected such as to operate with regular storage and return swings. Thus, the yarn is drawn into the storage position when the tension is low and subsequently released from this storage position, i.e. returned, when the tension is high. This returning operation releases the yarn from its storage position and replaces it (returns it), to its normal feed path.

A further advantage of the invention is that once actuated by the drive source, the rotation in one or other direction for the purpose of varying the preloading of the elastic element is irreversible so that the thrust of the elastic element against the shaft or the vibrations of the machine when in operation are unable to minimally modify the extent of said actuated rotation.

A preferred embodiment of the device of the present invention is described hereinafter by way of non-limiting example with reference to the single accompanying FIGURE.

This is a diagrammatic isometric view of the storage and intermittent return device of the present invention cooperating with the yarn guide element, the conical bobbin under formation being driven by the friction band of the drive roller, the figure showing the moment of maximum storage in the yarn path while the yarn guide element is moving in the increasing diameter direction of the cross-wound package.

In the single figure, the reference numeral 1 indicates the connection pin of the outer eyelet of the spiral elastic element 6. Said pin 1 is rigidly fixed in an integral manner to the mobile flat element 2; 2 is the mobile flat element which acts as the attachment and connection element for the outer eyelet of the elastic element 6; **2*a* is the position which the mobile flat element 2 assumes at that moment during its swing movement when the stored yarn length 18 is zero or a minimum; 3 is the bush or ring which rigidly joins together the two flat elements 4 and 2 of the storage and return lever system for the yarn being wound; 4 is that flat element which in cooperation with a deflecting roller 5 acts as the as the storage and return arm for the yarn 18 while also acting as the tension compensation and adjustment element for the yarn 18 being wound; 4*a* is the position which the mobile flat element 4 assumes at that moment during its swing movement when the stored yarn length 18 is zero or a minimum; 5 is a yarn deflecting roller or like element which operates as a mobile yarn guide element by moving with swing movement during the storage and return of the yarn 18. It is connected rigidly to the end of the mobile flat element 4 but is free to rotate about itself in order not to generate grazing friction against the yarn 18 under continuous collection movement. It also has a substantially cylindrical profile; 5***a* is the position which the mobile yarn deflecting and guide roller 5 assumes at that moment during its swing movement when the stored yarn length 18 is zero or a minimum; 6 is the spiral elastic element which stores drive energy by means of appropriate deformation resulting from its loading by angular rotation applied by the shaft 10 which is connected to its inner end. It consists of a steel strip or wire or a like steel shape, wound substantially as a flat Archimedes spiral and able to sustain torsion moments in both directions; 7 is an electronic or electromagnetic tension measurer or tensiometer able to measure the yarn winding tension at every moment; 8 is a central unit which combines an electrical comparator with an electronic microprocessor of known type; 9 is the drive source which operates the shaft 10, it consisting of a pneumatic, hydraulic or electrical actuator or a combination of two or more of these types; 10 is a shaft rotated angularly by the drive source 9 to vary the preloading of the spiral elastic element 6 for the purpose of regularizing the yarn winding tension. Said shaft is fixed or hinged, at or in proximity to its end, to the inner end of the spiral elastic element 9; 11 is a fixed yarn deflecting and guide roller having a substantially cylindrical profile and connected rigidly to the base plate 13 but free to rotate about itself to not generate grazing friction against the yarn 18 undergoing continuous collection movement; 12 is a fixed yarn deflecting and guide roller of substantially cylindrical profile connected rigidly to the base plate 15 but free to rotate about itself; 13 is the base plate for the roller 11, and is fixed to the machine structure, not shown on the figure; 15 is the base plate for the roller 12 and is fixed to the machine structure, not shown on the figure; 14 and 16 indicate a pair of rollers positioned along the path of the yarn 18, both rollers being pressed against each other with said yarn 18 passing between them to withdraw it from a spinning unit of a rotor spinning machine and feed it from its outlet towards the compensator device of the present invention at constant speed; 18 is the collected yarn subjected to storage and return at the outlet of the pair of feed rollers 14 and 16; 20 is a solid or hollow shaft of substantially circular or polygonal cross-section which is operated as a control rod for the yarn guide elements 26 by means of a suitably shaped cam so as to transmit a movement of suitable kinematic and dynamic characteristics to said thread guide elements 26; 22 is the drive roller for rotating the conical bobbin 24 under formation; 24 is the cross-wound yarn bobbin under formation; 26 is the yarn guide element driven with reciprocating to-and-fro motion by the drive shaft or rod 20, this latter extending along the entire operational winding face; 28 is the friction region in the form of a narrow circular band, for driving a conical bobbin by the drive roller 22; 30 is a blade for deflecting the path of the yarn 18 and can be of linear or shaped profile of known type; 32 is the support plate for the pivot 46; 34 is the bobbin carrier arm which supports the yarn package 24 as its diameter increases; 38 is the connection cable between the tension measurer 7 and the central unit 8; 40 is the connection cable between the central unit 8 and the drive source 9; 42 indicates the swing path of the mobile flat element 4; 44 indicates the reciprocating to-and-fro movement path of the shaft 20; 46 is the pivot about which the yarn storage and intermittent return lever system swings by way of the bush coupling 3; 48 is the drive shaft which extends along the entire winding face.

The operation of the device according to the invention is as follows.

The purpose of the storage and return device for the yarn 18 being wound onto the conical bobbin 24, according to the invention, is to adapt the varying winding speed deriving from the taper of the bobbin 24 to the constant outlet speed from the feed rollers 16 and 14. The average winding speed corresponds substantially to the spinning speed of the spinning chamber. When the yarn 18 is being collected on the minor diameter of the bobbin 24 the winding speed is less than the feed speed from the extracting rollers 14 and 16, and the lever system by means of its mobile element 4 stores a suitable length of yarn 18. This stored length is returned gradually as the collection speed increases on moving the yarn towards the major diameter of the bobbin 24 by means of the yarn guide element 26.

The ratio of the minor diameter to the major diameter of the bobbin 24 under formation determines the maximum length of yarn 18 which has to be stored and then returned for each complete transverse cycle of the yarn guide element 26.

As said ratio decreases continuously with increasing fullness of the bobbin 24 under formation, the amplitude of the swing movement of the mobile yarn deflecting and guide roller 5 also decreases for decreasing storage of yarn 18.

The mobile deflecting roller 5 generates a loop by deflecting the yarn 18 from its path. This loop therefore has a continuously varying amplitude and the device of the present invention automatically controls this loop by acting as a compensator for the periodic tension variations which arise as a result of the periodic winding speed variations in the formation of a conical bobbin 24.

In order to compensator said tension variations to which the collected yarn 18 is subjected and level them out to a substantially constant value, the mobile deflecting roller 5 has to assume different positions relative to the fixed deflecting rollers 11 and 12.

Because of the rigid connection, this variation in the position of the mobile deflecting roller 5 also corresponds to the swing of the two flat elements 4 and 2. The flat element 2 acts as the attachment and connection element for the outer eyelet of the spiral elastic element 6 which generates a reaction force such as to oppose the force produced by the tension of the yarn being wound.

Because of the rigidity of the connection between the two flat elements 4 and 2, said opposing force balances at every moment the elastic reaction force at the storage roller 5 with the force produced by the tension of the yarn 18 being wound.

The periodic variation in the speed at which the yarn 18 is wound onto the conical bobbin 24 results in a variation in yarn tension. This latter tension variation is stabilised about the average value of the elastic return force of the elastic element 6 which is subjected to a deformation which swings between two positions exactly related to the swing positions of the flat element 4 and storage roller 5.

The deflection of the stored yarn therefore depends at any moment on the tension of the winding underway, the value of which is measured by the tension measurer 7 and fed as electrical signals to the electrical comparator of the central unit 8.

If during the continuous winding process the variable yarn tension remains within the limiting values of a predetermined regular tension range as set in the electrical comparator, this latter generates no electrical output signal and the electronic control unit remains deactivated while the yarn tension remains within said regular range.

No activation signal for the drive source 9 appears at the output of the central unit 8 and is therefore not fed.

If the yarn tension assumes a value outside the limits of the regular range, the electrical comparator generates an electrical output signal which activates the electronic control unit of the central unit 8. This latter instantly provides at its output a control signal which activates the drive source 9, which angularly rotates the shaft 10 such as to vary the preloading of the spiral elastic element 6 in order to regularize the tension of the yarn 18 to within the limits of the regular predetermined preset range. The limiting values of said range depend largely on the type of yarn and type of bobbin to be obtained.

This latter operation can be further clarified as follows. If the tension of the yarn 18 assumes a value which exceeds the maximum regular range limit as set in the electrical comparator, the drive source 9 is activated by the central unit 8 and rotates the shaft 10 angularly in the direction which slightly reduces the amount of preloading of the spiral elastic element 6. This latter element therefore slackens and compels the yarn, by means of the lever system 2, 3, 4 and 5, to collect on the conical bobbin under an average tension which is slightly lower than the preceding situation.

Said reduction in the average tension of the yarn 18 during the continuous winding process must be sufficiently gradual to not allow the formation of tangles, knots or similar defects which if collected on the bobbin would lower its quality.

If the tension of the yarn 18 assumes a value below the minimum limit of the regular range, the drive source 9 is actuated by the central unit 8 and rotates the shaft 10 angularly in the direction which slightly increases the amount of preloading of the spiral elastic element 6. This latter element therefore tightens and compels the yarn, by means of the lever system 2, 3, 4 and 5, to collect on the conical bobbin under an average tension which is slightly higher than the preceding situation. This increase in the average tension of the yarn 18 being continuously wound can be substantially rapid as there is no danger of forming knots, tangles or similar defects.

The applicant has found that the device for intermittenly storing and returning yarn during the winding of conical bobbins fed with yarn at constant speed, according to the present invention, operates very reliably and periodically compensates the variations in yarn tension without the mobile deflecting roller 5 undergoing uncontrollable swing.

The use of the device according to the invention is not limited to the winding of conical bobbins produced on a rotor spinning unit, but can also be advantageously applied to the winding unit of any winding unit.

A preferred embodiment has been described herein but it is apparent that other embodiments are possible which fall within the scope of the present invention.

Thus the positions of the operating lever systems can vary; different drive arrangements can be provided; it is also possible to vary the shapes and dimensions of the yarn deflecting-storage roller together with the two flat elements 4 and 2 which undergo swing movement; ratios and dimensions of the various operational elements can also vary; modifications of a practical applicational nature can be made; thus for example an elastic membrane, pneumomechanical or other like tension measurer can be used. The various processed signals can obviously be functions of other physical quantities related to the aforesaid, as the arrangement of the various units of the device can be easily modified according to the types of quantities to be processed or compared. The invention so conceived is susceptible to numerous modifications, all of which fall within the scope of the inventive concept.

In addition, all details can be replaced by other technically equivalent elements; all without leaving the scope of the inventive idea as claimed hereinafter.

We claim:

1. A yarn storage and return device for yarn being wound on a conical bobbin driven at a constant speed comprising:

(a) a lever system including a shaft, an elastic element, and a pair of arms, which are connected to and move with each other, through which said shaft passes, and which can swing around the axis defined by said shaft, one of said arms having a deflecting roller and acting concurrently as a yarn storage and return means and a tension compensator and a regulator for the wound yarn, and the other of said arms connected to said elastic element, for generating a balancing counterforce to the tension of said wound yarn;

(b) a sensor for measuring the tension of yarn to be wound on the bobbin for generating electrical signals proportional to said tension of said yarn for indicating the tension thereof;

(c) an electronic comparator for comparing said electrical signals from said sensor with one or more reference signals which define a predetermined range of desired tension, and for generating a control signal when the tension is outside the predetermined range;

(d) an electronic control processor unit for converting said control signal from said electronic comparator into an activating signal; and (e) a drive source for adjusting the loading on said elastic element according to said activating signal from said electronic control processor unit for varying the tension of said storage and return arm to restore the winding tension to within the preset tension range.

2. The device of claim 1, wherein the elastic element is spiral.

3. In an apparatus for winding yarn on a conical bobbin driven at a constant speed, including a guide for guiding the yarn onto the bobbin and a support for supporting the bobbin, a device for storing and returning yarn being wound on the bobbin independent of said guide and said support, wherein the device comprises:

(a) a lever system including a shaft, an elastic element, and a pair of spaced apart arms which are rigidly joined by a bushing through which said shaft passes, and which can swing around the axis defined by said shaft, one of said arms having a deflecting roller and acting concurrently as a yarn storage and return means and a tension compensator and a regulator for the wound yarn, and the other of said arms connected to said elastic element, for generating a balancing counterforce to the tension of said wound yarn;

(b) a sensor for measuring the tension of yarn to be wound on the bobbin for generating electrical signals proportional to said tension of said yarn for indicating the tension thereof;

(c) an electronic comparator for comparing said electrical signals from said sensor with one or more reference signals which define a predetermined range of desired tension, and for generating a control signal when the tension is outside the predetermined range;

(d) an electronic control processor unit for converting said control signal from said electronic comparator into an activating signal; and (e) a drive source for adjusting the loading on said elastic element according to said activating signal from said electronic control processor unit for varying the tension of said storage and return arm to restore the winding tension to within the preset tension range.

4. A method for storing and returning yarn being wound on a conical bobbin driven at a constant speed comprising the steps of:

(a) driving a lever system means having a storage and return arm means for storing and returning yarn, for compensating and regulating the wound yarn, and for generating a balancing counterforce to the tension of said wound yarn;

(b) measuring and indicating the tension of the yarn to be wound on the bobbin and generating electrical signals proportional to said yarn tension by a tension sensor means;

(c) comparing said electrical signals from said sensor means with one or more reference signals which define a predetermined range and generating a control signal by an electric comparator means when the tension is outside the predetermined range;

(d) converting said control signal from said electric comparator means into an activating signal by an electronic control processor unit means; and (e) adjusting the loading of a spiral elastic element of said lever system means by a drive source means according to said activating signal from said electronic control processor unit means.

* * * * *